United States Patent [19]

Tsuge

[11] 4,085,848

[45] Apr. 25, 1978

[54] HOLDER DEVICE FOR SUSPENDING ARTICLES SUCH AS PAPER AND THE LIKE

[76] Inventor: Kenji Tsuge, 1-3-16 Higashi Kaigan Tsujido, Fujisawa City, Japan, 251

[21] Appl. No.: 832,107

[22] Filed: Sep. 12, 1977

[30] Foreign Application Priority Data

Jan. 10, 1977 Japan ..... 52-753

[51] Int. Cl.[2] ..... A44B 21/00; A47F 7/16

[52] U.S. Cl. ..... 211/45; 24/244; 24/263 SW; 211/89; 248/316 F

[58] Field of Search ..... 24/244, 263 SW, 136 A, 24/67 R; 211/89, 45; 248/316 F

[56] References Cited

U.S. PATENT DOCUMENTS

| | | | |
|---|---|---|---|
| 2,231,883 | 2/1941 | Caccivio | 24/244 |
| 2,377,488 | 6/1945 | Fugazzi | 211/89 |

*Primary Examiner*—Bernard A. Gelak
*Attorney, Agent, or Firm*—Edward A. Sokolski

[57] ABSTRACT

A device for suspending articles such as paper, has a plurality of balls which are slidably retained within a retainer in a series arrangement with each other. The retainer is formed from a back plate, a front plate opposite the back plate which is downwardly inclined towards the back plate, and top and side plates which join the front and back plates together. A slot is formed between the side plates and the back plate for receiving paper or the like to be retained by the device. In use, the device is supported on a wall or other support with the back plate secured to the support, and with the front plate inclined downwardly towards the back plate and the wall to form a ramp for the balls. When sheets of paper or the like to be retained in the device are pushed upwardly into the slot, they raise the balls somewhat in an upward direction, and pass between the balls and the back plate. When the paper sheets or other articles are released, the balls move downwardly along the inclined front plate by virtue of gravity and the paper sheets or the like are secured in place between the balls and the back plate. One or more of the sheets can be removed by drawing them out of the slot formed between the side plates and the back plate.

10 Claims, 17 Drawing Figures

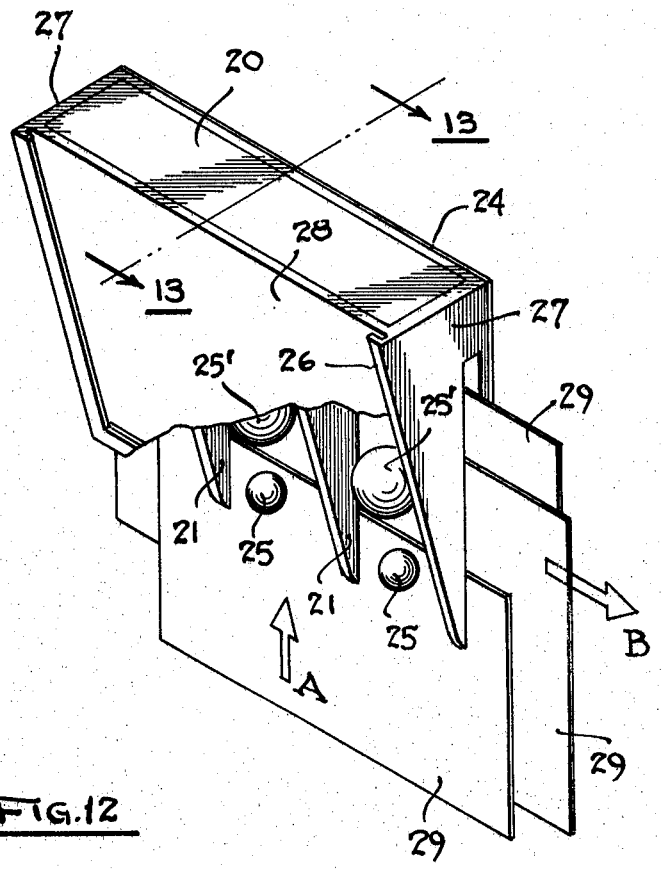
FIG.12
FIG. 13
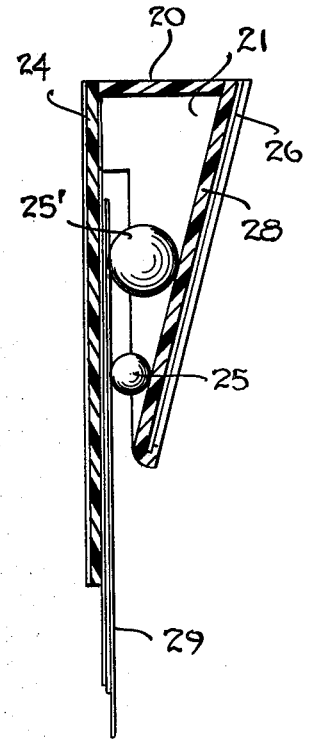
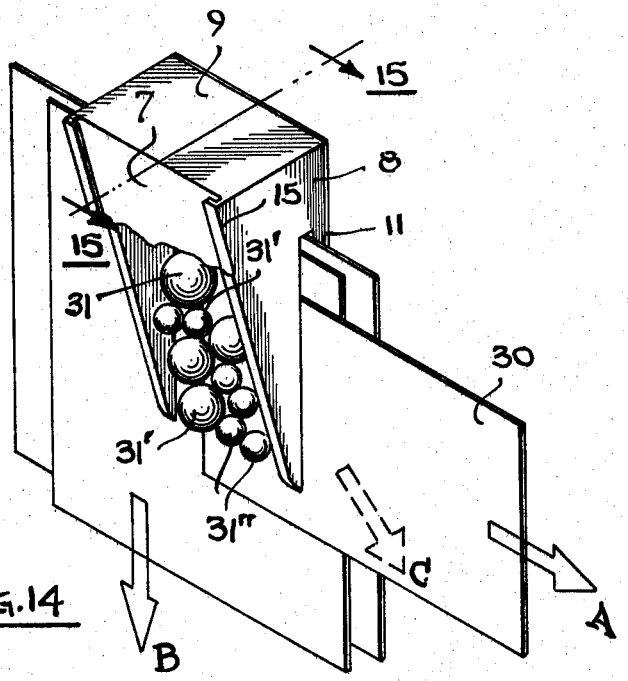
FIG.14
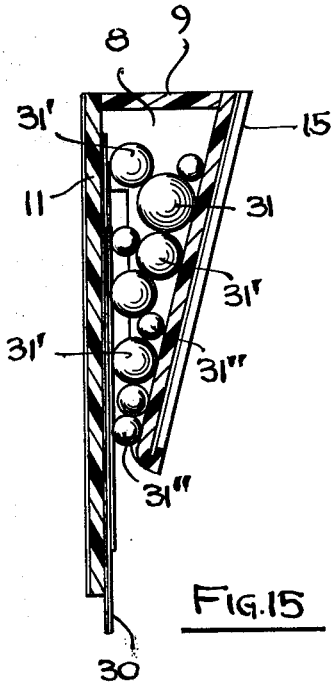
FIG.15

HOLDER DEVICE FOR SUSPENDING ARTICLES SUCH AS PAPER AND THE LIKE

This invention relates to a holder device suitable for use in retaining articles such as paper sheets, and more particularly to such a device which employs a plurality of serially arranged balls which are slidably held in a retainer device and which operate by gravity force in conjunction with an inclined plate to retain the paper sheets in the device.

Most holders for paper and the like either employ a spring clip or magnetic means in their implementation. These types of holders have the disadvantage of requiring the use of both of the operator's hands in both inserting and removing the article to be held. To overcome this shortcoming, holders have been developed which employ a ball which rides along an inclined surface which is opposite a wall mounted surface, a retainer being provided for the ball and a slot being formed between the inclined surface and the wall mounted surface wherein the article can be inserted. This type of device is described in U.S. Pat. No. 2,231,883 to Caccivio; U.S. Pat. No. 2,377,488 to Fugazzi; U.S. Pat. Nos. 1,235,600 and 1,233,506 to Reimer; U.S. Pat. No. 1,180,698 to Coupland; and U.S. Pat. No. 1,221,279 to Brisley. It has been found that where only a single ball is utilized, when a second sheet of paper is inserted in the device, the device has a tendency to release a first sheet of paper being held thereby, This occurs in view of the fact that as a second sheet of paper is inserted, it raises the ball in the retainer thereby loosening its hold on the first sheet of paper. Further, the use of only a single ball as in the prior art devices often does not provide as good holding action as would be desired.

Holder devices have been developed in the prior art as, for example, shown in U.S. Pat. Nos. 204,965 and 225,517 to Gilman which employ balls arranged in parallel with each other for providing the holding action. This device has the same shortcoming as the device utilizing a single ball in that all of the parallel arranged balls will be raised upwardly on the insertion of a second sheet, so as to release the hold on a first sheet already retained in the device.

The device of the present invention overcomes the aforementioned shortcomings of the prior art by providing a device which is capable of securely retaining paper sheets and other articles which can be inserted with the use of only one hand, and wherein additional sheets can be inserted in the device without releasing sheets already being retained therein. Further, in the device of the invention the sheets of paper can be readily removed by being drawn sideways, there being extra clearance between the ball and backplate provided when this removal operation is performed.

It is therefore an object of this invention to provide a holder for sheets of paper and the like having improved holding capability which can be used with only one hand, in which succeeding sheets can be placed without the release of sheets can be placed without the release of sheets already in the device.

It is a further object of this invention to provide an improved holder for sheets of paper and the like from which sheets can be readily removed.

It is a further object of this invention to provide an improved device for holding sheets of paper and the like which utilizes a plurality of balls which are serially arranged between converging plates.

Other objects of this invention will become apparent as the description proceeds in connection with the accompanying drawings, of which:

FIG. 12 is a perspective view of a third embodiment of the invention;

FIG. 13 is a cross-sectional view taken along the plane indicated by 13—13 in FIG. 12;

FIG. 14 is a perspective view of a fourth embodiment of the invention;

FIG. 15 is a cross-sectional view taken along the plane indicated by 15—15 in FIG. 14.

Briefly described, the device of my invention is as follows: The device includes a back plate in the form of a flat longitudinal strip, and a front plate member spaced from the back plate member, which is also in the form of a flat longitudinal strip and which is inclined downwardly towards the back plate member. The front and back plate members are joined together by a top plate and side plates, there being a slot or channel formed between the side plates and the back plate. A plurality of balls are retained in the receptacle formed between the plates, these balls being serially arranged and being free to ride along the ramp formed between the front and back plates. The back plate is mounted on a support such as a wall at a slant angle or vertically so that the balls are urged in a downward direction by the force of gravity. The balls are preferably made of successively lesser diameters going from the top to the bottom of the ramp, so that they are effectively separated from each other by the holding action afforded by the converging plates. Either the front or back plate may be laterally canted in a direction such that the spacing provided between these plates increases laterally in the direction in which the articles are withdrawn from the holder, thereby facilitating their removal. A second embodiment is described having a modified design which has the additional feature of providing a convenient receptacle for advertising material or the like. A third embodiment is described wherein a composite device is formed by arranging a plurality of the units of the second embodiment in parallel. A fourth embodiment is described utilizing the same holder assembly as the second embodiment but wherein there are a plurality of balls which are arranged in a random series-parallel fashion.

Figure 2:
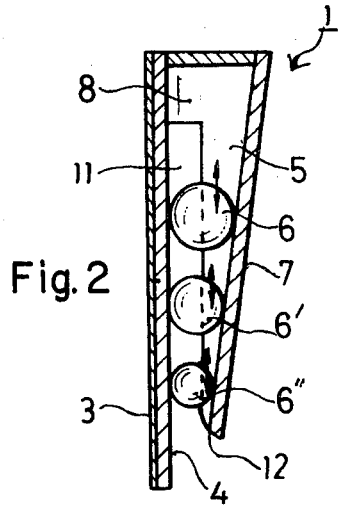
FIG. 2 is a cross-sectional view taken along the plane indicated by 2—2 in FIG. 1.
Figure 1:
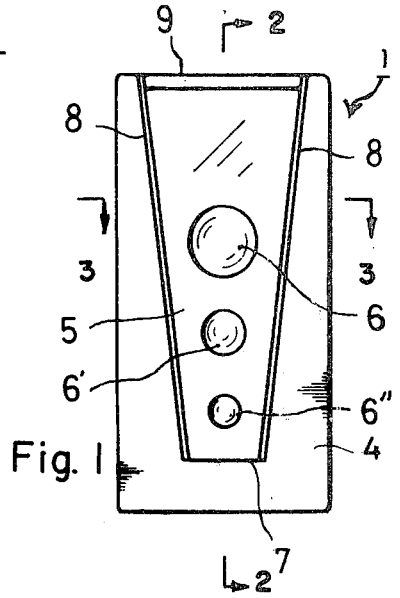
FIG. 1 is a front elevational view of a first embodiment of the invention with front plate removed from convenience of illustration.
Figure 3:
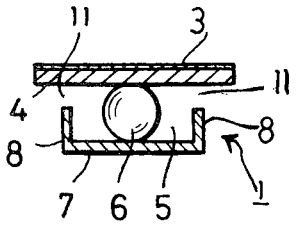
FIG. 3 is a cross-sectional view taken along the plane indicated by 3—3 in FIG. 1.
Figure 4:
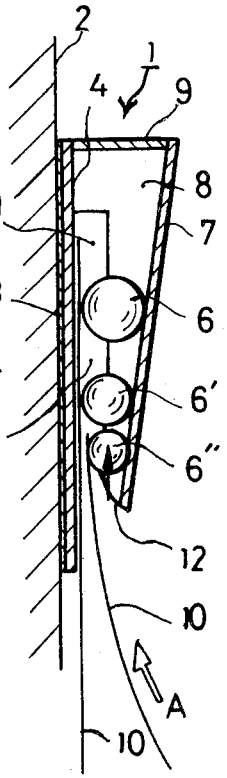
FIG. 4 is an elevational view in cross-section of the first embodiment showing a piece of paper being inserted therein.

Referring now to FIGS. 1–5, a first embodiment of the invention is illustrated. Holder assembly 1 has a back plate 4 in the form of an elongated flat strip which can be attached to a wall 2 or other support on a downward slope (i.e., at a vertical angle) by means of an adhesive strip 3 (as shown in FIG. 4). A retainer receptacle 5 is formed in the holder for balls 6, 6′ and 6″. Receptacle 5 is formed by front plate 7, back plate 4, side plates 8 and top plate 9. Front plate 7 is inclined downwardly towards plate 4, is of a longitudinal flat strip configuration and is tapered in a downward direction. Balls 6, 6′ and 6″ are successively smaller in diameter such that, as can be seen in FIG. 2, they come to rest by virtue of gravity separated from each other along the ramp formed by converging plates 7 and 4. This has the advantage of affording clamping action over separated portions of the sheets held by the device, and tends to avoid a jamming together of the balls. Formed between side plates 8 and back plate 4 are slots or channels 11 in which the sheets of paper 10, or other articles to be retained, are received. The bottom edges 12 of plates 8 are curved to guide the paper sheets into the channels.

Paper sheets 10, or other articles, are inserted into channels 11, as shown in FIG. 4, raising balls 6, 6′ and 6″ upwardly along inclined plate 7 as they are inserted, this upward motion facilitating the entry of the sheets. It is to be noted that as successive sheets are inserted and the balls are successively raised upwardly, the combined holding action of the three balls operates to hold sheets already retained in the holder in place. This is due to the fact that upward motion of each ball is most pronounced when the sheet first strikes against such ball. Thus, when the sheet is passing the first two balls, the third ball will still be firmly holding the other sheets in position. Then when the sheet finally strikes the third ball to lift it upwardly, the other two balls will not be receiving such upward drive and therefore will be able to retain the other sheets in position. As the paper sheets (or other articles) 10 are released from the grasp of the person inserting them, the balls 6, 6′ and 6″ will come to rest by virtue of gravity in their lowest positions along the ramp, thereby securing the paper sheets between the balls and plate 4.

Figure 6:
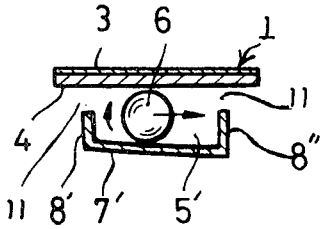
FIG. 6 is a lateral cross-sectional view illustrating a modified form of the first embodiment.
Figure 5:
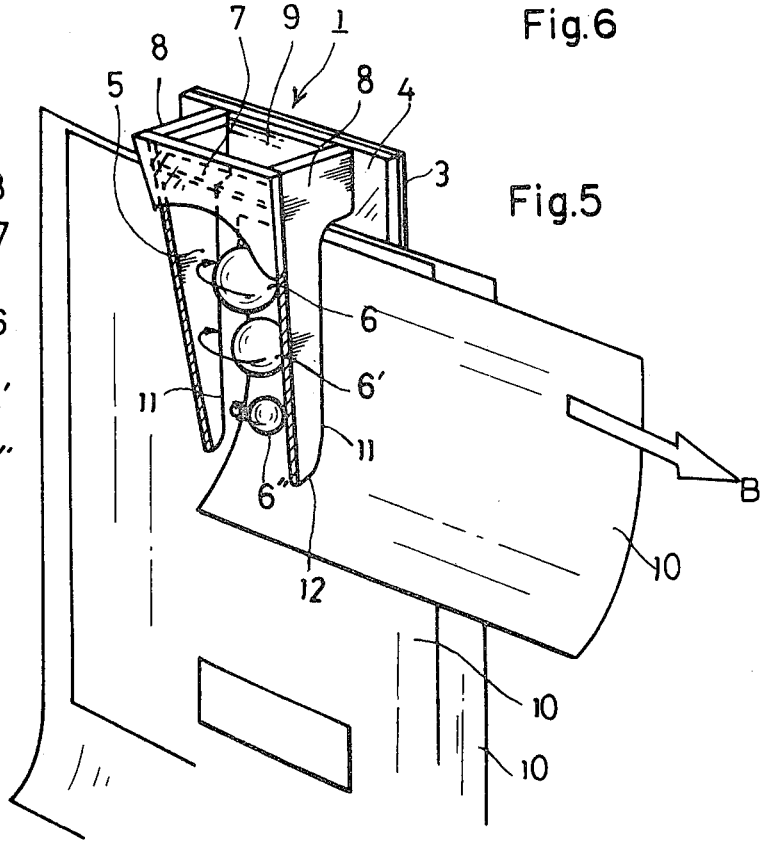
FIG. 5 is a perspective view of the first embodiment with the front wall partially cut away showing a piece of paper being removed from the device.
Figure 7:
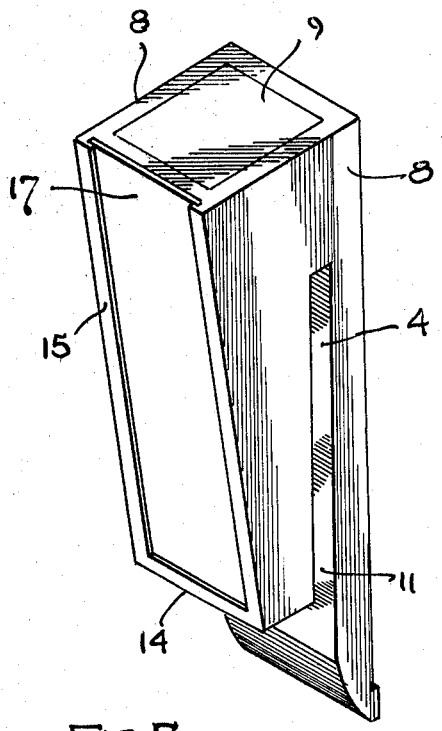
FIG. 7 is a perspective view of a second embodiment of the invention.

Sheets 10 are removed from the holder by pulling them sideways, as shown in FIG. 5. To facilitate such removal, front plate 7 may be canted laterally, as shown in FIG. 6, rather than being made to have a rectangular cross-section with the side plates (as shown in FIG. 3). Thus, as shown in FIG. 6, plate 7 is laterally inclined to the right away from plate 4, such that as a sheet of paper is removed from the holder to the right, a greater space is provided for the paper in this direction so as to facilitate its removal.

Thus, it can be seen that the device of the invention by employing a plurality of series arranged balls in its holding mechanism, has the advantage of enabling tight holding action of the article and permitting the insertion in the holder of additional sheets without releasing any of the sheets already within the holder.

Referring now to FIGS. 7 through 10, a second embodiment of the invention is illustrated. This second embodiment is particularly suited for molding out of plastic and incorporates a holder frame for use in retaining advertising material or the like. The same numerals are utilized for identifying parts of the second embodiment which correspond to those of the first. Except for the differences now to be described, the construction of this second embodiment is basically the same as that of the first embodiment.

In this second embodiment, back plate 4 is made to have the same width as front plate 7, rather than being of a greater width as in the first embodiment. Also, a cross piece 14 forming a lip interconnecting side walls 8 is provided along the bottom edge of front plate 7, which structure is not shown in the first embodiment. Further, the bottom edge 4*a* of back plate 4 is curved to provide a beveled entry lip for the sheets of paper. The second embodiment most significantly differs from the first in that a frame 15 is provided around the outer surface of front plate 7, this frame acting as a receptacle for a card 17 which is inserted therein. This card may be used to carry advertising material, reference information, a picture, etc.

Figure 11:
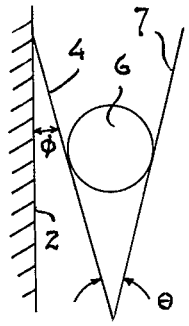
FIG. 11 is a diagrammatic view illustrating an optimum design for the device of the invention.
Figure 8:
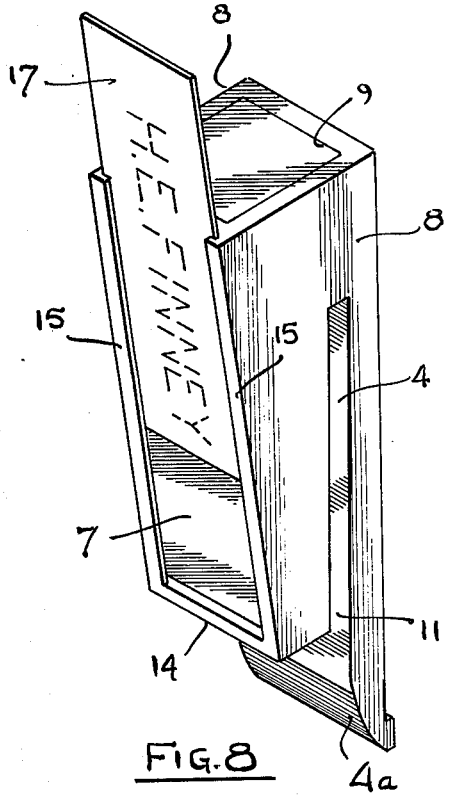
FIG. 8 is a perspective view of the second embodiment showing an advertising card being inserted therein.
Figure 9:
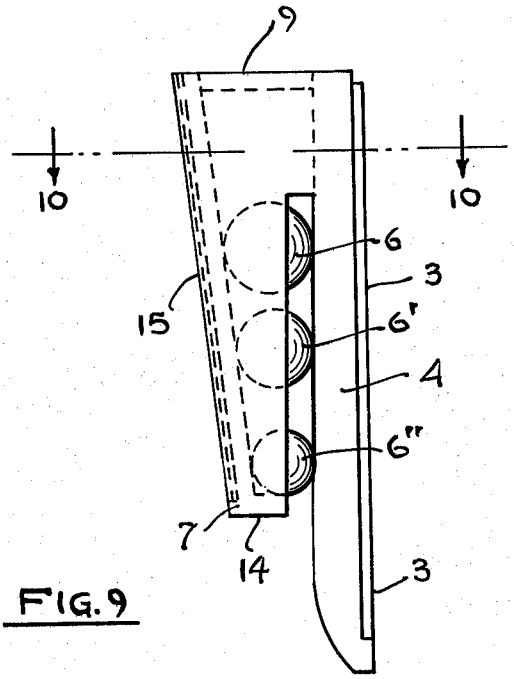
FIG. 9 is a side elevational view of the second embodiment.
Figure 10:
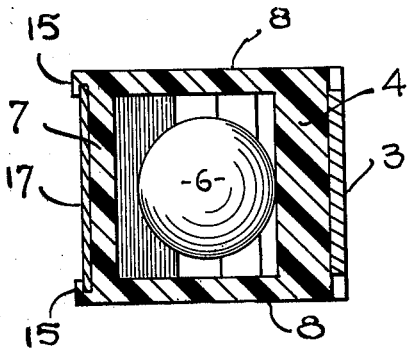
FIG. 10 is a cross-sectional view taken along the plane indicated by 10—10 of FIG. 9.

Referring now to FIG. 11, a schematic drawing is shown illustrating the operation of the device of the invention. It has been found by mathematical calculation that optimum holding action can be achieved when the angle $\phi$ between the surface of wall 2 and the surface of plate 4 is equal to half of the angle $\theta$ between the surfaces of plates 4 and 7. These calculations are made on the assumption that the surface of wall 2 is vertical. The mass of balls 6 should preferably be high, a material such as steel being found to be ideal.

Referring now to FIGS. 12 and 13, a third embodiment of the invention is illustrated. This third embodiment is synthesized from a plurality of units of the second embodiment arranged in parallel to form a composite unit. This composite unit has a top plate 20, side plates 27, a back plate 24 and a front plate 28. As for the previous embodiments, front plate 28 is inclined downwardly towards back plate 24. Plates 21 divide the unit into a plurality of separate channels. A separate ramp is formed in each of the channels between converging plates 24 and 28. Each of the channels forms a receptacle for a smaller ball 25 and a larger ball 25′. As for the previous embodiment, a frame 26 for holding a card is provided. As for the previous embodiments, sheets of paper 29 are preferably inserted in an upward direction as indicated by the arrow "A" in FIG. 12, and removed in a lateral direction as indicated by the arrow "B." This embodiment affords the advantage of multiplying the holding force by the number of holding units employed and is particularly useful where a great number of heavy sheets are to be retained. While only three units are shown in the illustrative embodiment, many more such units can be employed to increase the holding action.

Referring now to FIGS. 14 and 15, a fourth embodiment of the invention is shown. This embodiment employs a holder unit which is essentially the same as that for the second embodiment but differs therefrom in that rather than using serially arranged successively smaller balls, a fairly larger number of balls 31, 31′ and 31″ of different sizes are used, these balls being arranged in a random fashion to form both series and parallel arrangements. This embodiment has the advantage of providing the improved holding action of a series-parallel arrangement of balls. Further, it permits the use of smaller and hence lighter balls. Also, as shown in FIG. 14, this embodiment tends to permit the removal of a sheet of paper 30 therefrom at both a downward angle (as indicated by arrow "B") and an oblique angle (indicated by arrow "C") as well as a lateral angle (indicated by arrow "A"). This fourth embodiment is particularly suitable in situations where space or other considerations make it difficult or impossible to remove the sheets laterally. To facilitate downward removal of the paper, the angle between front plate 7 and back plate 11 should be made relatively large.

Figure 16:
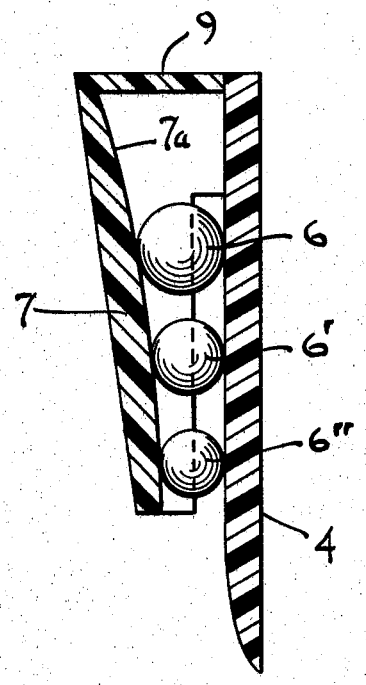
FIGS. 16 and 17 are cross-sectional views of additional embodiments of the invention wherein an increased distance is provided between the front and back plates at the upper portions thereof.
Figure 17:
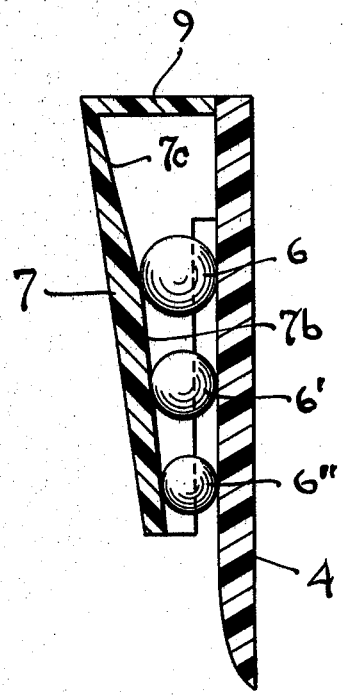

Referring now to FIGS. 16 and 17, further embodiments of the invention are shown which embodiments are particularly suitable for use in situations where the papers to be held may be relatively numerous and/or thick, so as to present a relatively thick load for the device. As can be seen in FIG. 16, the inside wall *7a* of the front plate 7 is curved so as to provide a greater increase in the space between the front plate 7 and the back plate 4 at the upper portions thereof than is afforded by a linear front plate. This same increased separation between the front and back plates can also be achieved as shown in FIG. 17 by providing a first portion *7b* of the inside wall of the front plate which has a first smaller slope relative to the back plate 4, and a second portion *7c* having a larger slope relative to the back plate. In both the last described embodiments, it can be seen that the uppermost balls have additional clearance space provided between them and the front plate at their uppermost positions of travel, so as to enable the insertion of a thicker load of papers in this space. This assures that the uppermost balls will operate to hold a thicker load of papers and will not merely be pushed upwardly by such a load.

While the invention has been described and illustrated in detail, it is to be clearly understood that this is intended by way of illustration and example only and is not to be taken by way of limitation, the spirit and scope of this invention being limited only by the terms of the following claims.

I claim:

1. A holder device for suspending articles comprising:

a back plate, a front plate, a top plate and a pair of side plates joining said front and back plates together, a slot being formed between said back plate and a portion of said side plates, said front plate being inclined towards said back plate in the direction running from said top plate to form a ramp, said top, front, back and side plates forming a receptacle, a plurality of balls retained in the receptacle formed by said plates in a series arrangement along the ramp formed between said front and back plates, and means for mounting said holder with said back plate running at a downward verticle angle, whereby when articles are inserted in said slot, they pass between said balls and said back plate and are retained by the gravity action of said balls after they are so inserted.

2. The device of claim 1 wherein said balls are of increasingly smaller diameter in going from the top of said holder to the bottom thereof so as to afford separation between the balls when they are in their lowermost gravity driven positions.

3. The device of claim 1 wherein said front plate is laterally tilted with respect to said back plate such that a greater spacing is afforded between said two plates for removing an article from one side of said holder.

4. The device of claim 1 further including a frame formed along the edges of the outer surface of said front plate, said frame being adapted to receive a strip therein.

5. The device of claim 1 and further including a lip running along the bottom edge of said front plate and joining together the bottom edges of said side plates.

6. The device of claim 1 wherein the bottom edge of said back plate is beveled to facilitate the entry of the articles into the slot.

7. The device of claim 1 wherein the balls are of various sizes and are placed randomly in a series-parallel arrangement.

8. The device of claim 1 and further including a plurality of said holder devices arranged in parallel with each other and integrated together to form a composite unit.

9. The device of claim 1 wherein the inside surface of one of said back and front plates is curved to provide increased spacing between said back and front plates near the top portions thereof.

10. The device of claim 1 wherein the inside surface of one of said back and front plates has a first portion having a first smaller slope relative to the other of said back and front plates, and a second portion having a larger slope relative to the other of said back and front plates, said second portion being near the top portions of said device so as to provide increased spacing between said back and front plates near the top portions thereof.

* * * * *